United States Patent [19]

Loncaric

[11] 4,224,655

[45] Sep. 23, 1980

[54] ANTI-ELECTROSTATIC PROCEDURE FOR OPENING PETROLEUM EQUIPMENT

[75] Inventor: Rado G. Loncaric, Dallas, Tex.

[73] Assignee: Atlantic Richfield Company, Los Angeles, Calif.

[21] Appl. No.: 16,642

[22] Filed: Mar. 1, 1979

Related U.S. Application Data

[63] Continuation-in-part of Ser. No. 859,773, Dec. 12, 1977, abandoned.

[51] Int. Cl.[3] ..... H05F 3/00

[52] U.S. Cl. ..... 361/215

[58] Field of Search ..... 361/212, 215

[56] References Cited

U.S. PATENT DOCUMENTS

| | | | |
|---|---|---|---|
| 3,013,578 | 12/1961 | Askevold | 361/215 X |
| 3,428,061 | 2/1969 | Graham | 361/215 X |
| 3,728,156 | 4/1973 | Miller | 361/215 X |
| 3,893,003 | 7/1975 | Dancy | 361/215 |
| 4,057,071 | 11/1977 | Rhodes | 361/215 X |

FOREIGN PATENT DOCUMENTS

| | | | |
|---|---|---|---|
| 7506003 | 11/1976 | Netherlands | 361/215 |

*Primary Examiner*—Harry E. Moose, Jr.

*Attorney, Agent, or Firm*—M. David Folzenlogen

[57] ABSTRACT

In the production and transportation of crude oil and natural gas in dry, cold areas, such as for example, the North Slope of Alaska, static electricity inside equipment like tanks and flowlines is a special problem when it is necessary to gain access to the inside of such equipment. Safer and faster access to the inside of such equipment is facilitated by removing petroleum fluids from the equipment and wetting the appropriate inside area of access of the equipment with a nonflammable liquid that facilitates discharge of the electrostatic potential. For example, the liquid may be a salt solution, an antistatic chemical solution, a solution of conductivity improvers, or a combination thereof. The nonflammable liquid must be flowed (preferably upwardly) into the area of access as a continuous stream of liquid. In other words, the nonflammable liquid is not atomized or turned into a spray. Sprays create electrostatic charges. A noncombustible gas may be used to displace combustible gases from the equipment and to prevent entry of oxygen into the equipment while being drained and opened. For added safety, a radio receiver may be used to test for the presence of residual static discharges prior to commencing work inside such equipment.

16 Claims, No Drawings

ANTI-ELECTROSTATIC PROCEDURE FOR OPENING PETROLEUM EQUIPMENT

CROSS REFERENCE TO RELATED APPLICATIONS

This application is a continuation-in-part of Copending Application Ser. No. 859,773, filed Dec. 12, 1977, now abandoned, filed by the same inventor and owned by a common assignee.

BACKGROUND OF THE INVENTION

This invention pertains to a procedure for opening petroleum producing and transporting equipment in a way that reduces the danger of electrostatic sparking inside the equipment and decreases the time required to safely open such equipment.

In petroleum producing and transporting operations, static electricity has proven to be a source of fire hazard. Static electrical charge is generated at the internal surface of coated or uncoated petroleum handling equipment, and the interface of the solid, liquid and gas phases flowed, agitated, or settled in such equipment. The sign of the charge in the petroleum liquid depends on the materials involved. Some crude oils, for example, are negative while others are positive.

The charge in the liquid within a piece of producing or transporting equipment attracts an equal and opposite charge at the inner surface of the equipment, but the combination will give no external evidence of the charge. It is standard practice to ground all of the equipment to a common ground conductor, but in petroleum producing and transporting equipment, this will not prevent the formation of a hazardous internal electrostatic charge. This sort of electrical grounding works only when both the surface of the equipment and the petroleum liquid are highly conductive, and electrostatic charges are discharged as fast as they are produced. Petroleum producing and transportation operations use equipment with poorly conductive or coated surfaces and use fluids with relatively poor conductivity. Moreover, the fluids used frequently contain mixed phases. Mixed phases are prone to produce a static charge even if water is present as one of the phases.

When the fluid in such equipment is removed or drained so that some work may be done inside the equipment, the charge on the internal surface of the equipment and on petroleum and inorganic deposits in the equipment remains. The natural decline in the charge, in many cases, is excessively slow. When the petroleum materials are drained, the charge, therefore, remains dangerous in such equipment for costly and indeterminate periods. The danger is greatest in cold areas like those found and experienced in Alaska. In order to be safe, it would be necessary to keep such equipment sealed and out of service for a long period, for example, two weeks. If air leaked into such equipment during such waiting period and an explosive ratio of oxygen to flammable gas developed, an explosion could occur as the charge is dissipated.

U.S. Pat. No. 3,728,156 refers to a method of cleaning tanks using a high velocity liquid spray. In the cleaning method, the amount of electrostatic charge created by the spray is controlled by alternating between cleaning liquids that build opposite charges, e.g., alternating between salt water and fresh water. U.S. Pat. No. 3,893,003 refers to a method of reducing an electrostatic charge in a tanker by converting water or salt water to mist and spraying the mist inside the tank. It is said that the mist acquires a charge opposite in polarity to the polarity of the initial electrostatic charge in the tank. It is to be noted that in both of these patents a spray is used and the spray creates an electrostatic charge. This increases the hazards of sparking an existing electrostatic charge, rather than alleviating the hazard. As previously noted, the polarity of the charge inside the petroleum handling equipment varies. In this invention, these problems are overcome by using a continuous or steady stream of liquid designed to allow an existing electrostatic charge to dissipate or leak off without creating an opposite electrostatic charge which increases the hazard.

SUMMARY OF THE INVENTION

When petroleum producing and transporting equipment is opened, the hazards and delays caused by internal electrostatic charges are reduced by wetting the internal surface with a nonflammable liquid solution that increases the rate of discharge of static electricity inside the equipment. The liquid may be brine, water with an organic conductivity improver, a solution of antistatic chemicals, or a combination thereof. The antistatic chemicals have the advantage of a residual long lasting effect and of improved contact and electrostatic discharge.

The nonflammable liquid must be flowed (preferably upwardly) into equipment in a continuous or steady stream, that is, the liquid is not converted into droplets, a spray, or atomized. The safety of the procedure may be increased by flowing a noncombustion supporting gaseous fluid into the appropriate portion of the equipment. The noncombustion gas is best used as soon as practical to dilute and remove combustion supporting gaseous fluids. It is also desirable to maintain a positive pressure on the gas during the discharge period to further reduce the chances of explosion. Before the equipment is opened, it may be tested for the presence of electrostatic charge with radio equipment. The discharge or static electricity creates a static in radio equipment.

DETAILED DESCRIPTION OF THE INVENTION

The equipment is cold crude oil and gas producing areas like Alaska have been found to retain a hazardous amount of internal electrostatic charge. This equipment has many internal configurations, such as, tanks, pipelines, heat treaters, separators, pumps and the like. In addition to the normal hazards, in cold areas, the costs of damage and of operating delays are many times the cost of the same damage or delay in warmer producing areas. In addition, there is usually a shortage of standby equipment. Equipment down time tends to cause loss of production. When this equipment is opened, there is danger of explosion or fire unless the flammable or explosive petroleum material is removed and the equipment allowed to sit sealed from oxygen until the electrostatic charges are dissipated. This invention provides a procedure for opening petroleum producing and transporting equipment in areas where an internal electrostatic charge is likely to be present. The procedure decreases the waiting period and increases safety.

Before the equipment is opened for some operation, for example, the cleaning of a tank or the repair of a pipeline flange, the petroleum in the inside of the equipment in the area of the equipment that is affected by the planned operation is removed by any suitable procedure depending on the nature of the equipment. For example, the petroleum liquid may be drained, displaced with a nonflammable solution, or displaced with a noncombustion supporting gas. If the liquid petroleum in the equipment is removed in a way which will empty the equipment and tend to pull in air or to leave an explosive or flammable gas, it is best to displace the flammable fluid with a noncombustion supporting gaseous fluid, for example, flue gas, nitrogen or carbon dioxide from the portion of the equipment from which the liquid petroleum is removed. A positive noncombustion supporting gas pressure is advantageous during all of the equipment opening procedures set forth herein.

The inside surface of the appropriate portion of the equipment is wetted with a nonflammable liquid that increases the rate of discharge of the static electricity inside the equipment and reduces the danger of an electrostatically produced spark when the equipment is opened for the planned operation. The nonflammable liquid may be salt water of high conductivity. The antistatic liquid could be a water solution with a nonmetallic organic conductivity improving chemical, for example, at least 0.35 parts per million of an organic sulfur compound. The nonflammable liquid could be a solution of anti-electrostatic compounds, for example, chromium salt or a mixture of mono- and di-alkyl salicylic acid and sodium di-sulpho-succinate. A mixture of quartenary ammonium chloride and ethoxylated high molecular weight amine is preferred. These compounds are particularly advantageous. They are surfactant, and surface adsorptive on one end and moisture collective on the other end. This adsorptiveness causes them to adhere to surfaces and provide a residual effect after the petroleum producing or transporting equipment is placed back in operation. These antistatic chemicals and the conductivity improvers could also be injected into the equipment or flowing petroleum fluids just prior to start of the equipment opening procedure of this invention. This would further reduce the chances of electrostatic sparking. The volume, concentration, or both, of the nonflammable liquid will be sufficient to speed up discharge of accumulated static electricity in the equipment. In other words, the antistatic liquid will allow or cause discharge of static electricity at a substantially higher rate than the petroleum, e.g., crude oil, normally occupying the producing or transporting equipment. The rate of discharge could be facilitated by incorporating highly conductive, noncorrosive rods or anodes in the equipment.

The nonflammable liquid must be flowed into the equipment in a continuous or steady stream. The words a "continuous stream" mean that the nonflammable liquid is not converted to a spray or mist, or droplets. Preferably, the liquid will be flowed upwardly to wet and fill the appropriate portion of the equipment with the nonflammable antistatic liquid. Upward flow of the liquid adds further protection against creating an electrostatic charge; moreover, the nonflammable liquid may be used as a displacing or chasing liquid for the liquid petroleum as the petroleum is removed from the equipment. After the nonflammable liquid has been flowed into the equipment, the flow of liquid will normally be ceased and the equipment and liquid allowed to stand quiescent for a period of time.

After the equipment has been treated with the nonflammable antistatic liquid, with or without the injection of a noncombustion supporting gas, the liquid will be removed from the portion of the equipment that is to be opened. At this point, for added safety, a radio receiver could be inserted or lowered into the equipment. If electrostatic charges are still present and discharging, the receiver will set up a crackling or static noise. When it is deemed safe, the equipment will be opened.

Variants of the above described anti-electrostatic equipment opening procedure will readily occur to those skilled in the art. This invention is to be construed not as limited to the examples given, but its scope is defined by the appended claims.

The embodiments of the invention in which an exclusive property or privilege is claimed are defined as follows:

1. A method of opening liquid petroleum handling equipment comprising removing liquid petroleum from the portion of said equipment to be opened; flowing a continuous stream of nonflammable liquid into said portion of said equipment to wet the inside surface of said portion, said nonflammable liquid characterized by the fact that said nonflammable liquid increases the rate of discharge of static electricity inside said equipment, thereby reducing the danger of electrostatic sparking when said portion of said equipment is opened, removing said nonflammable liquid from said portion of said equipment, and opening said portion of said equipment.

2. The method of claim 1 wherein the method includes the step of following a noncombustion supporting gaseous fluid into a portion of the equipment.

3. The method of claim 1 wherein the inside portion of the equipment is tested with radio equipment for electrostatic charge before the portion is opened.

4. The method of claim 1 wherein the nonflammable liquid is flowed into the portion of the equipment upwardly thereby filling said portion with said nonflammable liquid.

5. The method of claim 1 wherein the nonflammable liquid is comprised of salt water.

6. The method of claim 5 wherein the method includes the step of flowing a noncombustion supporting gaseous fluid into a portion of the equipment.

7. The method of claim 5 wherein the inside portion of the equipment is tested with radio equipment for electrostatic charge before the portion is opened.

8. The method of claim 5 wherein said nonflammable liquid is flowed into the portion of the equipment upwardly thereby filling said portion with said nonflammable liquid.

9. The method of claim 1 wherein the nonflammable liquid is comprised of water containing an organic conductivity improver.

10. The method of claim 9 wherein the method includes the step of flowing a noncombustion supporting gaseous fluid into a portion of the equipment.

11. The method of claim 9 wherein the inside portion of the equipment is tested with radio equipment for electrostatic charge before the portion is opened.

12. The method of claim 9 wherein said nonflammable liquid is flowed into the portion of the equipment upwardly thereby filling said portion with said nonflammable liquid.

13. The method of claim 1 wherein the nonflammable liquid is comprised of water containing an antistatic chemical which has surfactant and surface adsorptive properties.

14. The method of claim 13 wherein the method includes the step of flowing a noncombustion supporting gaseous fluid into a portion of the equipment.

15. The method of claim 13 wherein the inside portion of the equipment is tested with radio equipment for electrostatic charge before the portion is opened.

16. The method of claim 13 wherein said nonflammable liquid is flowed into the portion of the equipment upwardly thereby filling said portion with said nonflammable liquid.

* * * * *